US007887246B2

(12) United States Patent
Hori

(10) Patent No.: US 7,887,246 B2
(45) Date of Patent: Feb. 15, 2011

(54) LIQUID SUPPLY DEVICE

(75) Inventor: Eiji Hori, Sakado (JP)

(73) Assignee: Yayoi Hori, Sakado-Shi, Saitama (JP)

( * ) Notice: Subject to any disclaimer, the term of this patent is extended or adjusted under 35 U.S.C. 154(b) by 1097 days.

(21) Appl. No.: 11/629,485

(22) PCT Filed: Dec. 6, 2004

(86) PCT No.: PCT/JP2004/018125

§ 371 (c)(1),
(2), (4) Date: Dec. 14, 2006

(87) PCT Pub. No.: WO2005/123416

PCT Pub. Date: Dec. 29, 2005

(65) Prior Publication Data

US 2008/0063463 A1 Mar. 13, 2008

(30) Foreign Application Priority Data

Jun. 22, 2004 (JP) ..... 2004-183326

(51) Int. Cl.
*B43K 5/00* (2006.01)

(52) U.S. Cl. ..... 401/199; 401/198

(58) Field of Classification Search ..... 401/198, 401/199, 223–225

See application file for complete search history.

(56) References Cited

U.S. PATENT DOCUMENTS 5,336,009 A 8/1994 Young
5,556,215 A * 9/1996 Hori ..... 401/199
5,865,553 A 2/1999 Flye Sainte Marie et al.
5,927,885 A 7/1999 Duez et al.
6,089,776 A * 7/2000 Kaufmann ..... 401/199
6,659,671 B1 * 12/2003 Fukami et al. ..... 401/198
6,702,498 B2 3/2004 Konose
6,997,631 B2 * 2/2006 Yamada et al. ..... 401/199

FOREIGN PATENT DOCUMENTS

| | | |
|---|---|---|
| DE | 199 48 477 A1 | 4/2001 |
| JP | 2001-171285 | 6/2001 |
| JP | 2001-315483 | 11/2001 |
| JP | 2004-50694 | 2/2004 |
| JP | 2004-330710 | 11/2004 |
| WO | WO 03/018327 A1 | 3/2003 |

* cited by examiner

*Primary Examiner*—David J Walczak
(74) *Attorney, Agent, or Firm*—Manabu Kanesaka

(57) ABSTRACT

A liquid supply device has a main body having a hollow portion; a partition that divides the hollow portion into a liquid storage chamber; a reservoir chamber communicated with the atmosphere; and a through hole formed in the partition. An application material is provided in the main body and applies the liquid in the liquid storage chamber. A porous relay core supplies the liquid in the storage chamber to the application material and is inserted in the through hole to form a gap with an inner wall of same, the gap holding the liquid by capillary force. A partition extending portion extends from the partition and protrudes to the liquid storage chamber side along the relay core. The relay core is inserted to form a gap holding the liquid by capillary force.

21 Claims, 19 Drawing Sheets

(a)

LIQUID SUPPLY DEVICE

TECHNICAL FIELD

The present invention relates to a liquid supply device such as, for example, a pen (writing instrument) stamp and cosmetic that accommodates various types of liquids to supply to an application portion.

BACKGROUND ART

As the liquid supply device as described above, for example, Patent Document 1 discloses a writing instrument that stores liquid ink. In the writing instrument, a main body is provided with a partition, and the partition divides between an ink storage chamber that stores the ink and a reservoir chamber communicated with the atmosphere. A through hole is formed in the partition to insert a-rod-shaped ink supply material (relay core) made of a porous material, and a gap to hold the ink by capillary force is formed between the outer periphery of the ink supply material and an inner wall of the through hole.

The ink membrane held in the through hole breaks due to an increase or decrease in the pressure inside the ink storage chamber, and the so-called gas-liquid exchange action is obtained such that the ink flows into the reservoir chamber, the air flows into the ink storage chamber, and the like. Such gas-liquid exchange action is a preferable structure to compensate for changes in the ambient temperature and changes in the pressure inside the ink storage chamber. Further, when the ink is consumed by the writing instrument, the ink in a portion where the ink is held by capillary force is sucked out, the gas-liquid exchange action is performed in the portion, the sensitivity of ink supply to a pen material becomes excellent, and the writing instrument thus has a structure where light and shade is hard to occur in writing.

The publication further discloses a structure where the reservoir chamber is provided with a porous ink holding material made of cotton or the like, or with a feeder mechanism such that a number of gaps are formed continuously along the axis direction so as to hold the ink flowing out of the ink storage chamber due to changes in temperature and the like. By providing such an ink holding material or feeding mechanism, it is intended to effectively prevent the ink from leaking from the atmosphere communication hole to the outside and the like. The publication also discloses a structure for dividing the ink storage chamber by a plurality of partitions to reduce a drain of the ink to the reservoir chamber.

In relation to the writing instrument as disclosed in above-mentioned Patent Document 1, Patent Document 2 discloses a structure for increasing a return rate of ink flowing into the reservoir chamber. More specifically, the reservoir chamber is provided with an ink drain preventing member that divides the reservoir chamber while causing an ink supply material to be inserted into the preventing member with a predetermined gap, and thus is configured to return the ink flowing into the reservoir chamber on the pen side to the ink supply material.

In the above-mentioned well-known writing instrument, since the ink supply material is disposed in the center portion and the gas-liquid exchange is performed around the ink supply material (the gas-liquid exchange is not performed inside the ink supply material), the sensitivity of the gas-liquid exchange is improved, and it is possible to supply the ink inside the ink storage chamber to the pen side (application side) promptly. The ink is thereby supplied with high sensitivity even in writing at high speed, and advantages are obtained of enabling resolution of troubles such that a thin spot occurs, writing becomes impossible and the like.

However, there is a problem that the ink inside the ink storage chamber tends to flow into the reservoir chamber side due to the head pressure acting on a gap portion formed in the partition, changes in temperature, and particularly, changes in pressure by increases in temperature. In other words, the above-mentioned writing instrument is used under various circumstances that the temperature is varied, its position is varied and the like, and for example, when the temperature increases and the pressure inside the ink storage chamber increases, the ink flows out of the gap formed in the partition into the reservoir chamber. In this case, as disclosed in Patent Document 1, by providing the reservoir chamber with a porous ink holding material, it is possible to absorb the flowing-out ink and suppress leakage of the ink to the outside and the like. Alternately, also in the structure as disclosed in Patent Document 2, it is possible to prevent the ink from leaking to the outside, and to bring the ink flowing out of the ink storage chamber into contact with the ink supply material to return thereto.

Further, in the above-mentioned writing instrument, it is desirable in the appearance that the ink stored in the ink storage chamber in each writing instrument is maintained at a certain amount when a number of writing instruments are arranged to sell, for example. In other words, when the amount of the ink in the ink storage chamber is different between writing instruments of the same type, the sale is affected (a writing instrument with a small amount of ink in the ink storage chamber cannot be sold, or some store refuses to display such a writing instrument, and the like.)

Generally, in the above-mentioned writing instruments, a lapse of time differs (the season also differs) before the instrument is placed for sale in a retail store through the manufacturing process and shipment process, and the apparent ink storage amount may differ largely for each writing instrument by the ink flowing into the reservoir chamber due to various factors such as changes in temperature, changes in position and the like during the lapse of time.

Meanwhile, in the writing instrument such that the ink storage chamber is divided by a plurality of partitions, since each chamber stores the ink, it is possible to prevent the apparent ink storage amount from differing largely. However, dividing the ink storage chamber into a plurality of chambers increases the number of parts, makes the assembly process complicated, and increases the cost. Further, when a pigment-based liquid (mixture of solvent and pigment) is used, the need arises of storing a spindle for mixing in the chamber, and storage of the spindle in not preferable in terms of the cost. Furthermore, since a plurality of storage chambers is formed along the axis direction, it is difficult to perform the operation for refilling the liquid.

Accordingly, in the writing instrument (liquid storing device) with the above-mentioned structure, it is desirable that such changes in the ink storage amount are reduced as much as possible in a simple structure, while the above-mentioned advantages are maintained (such that the sensitivity of ink supply to a pen material is excellent, light and shade is hard to occur in writing, and the like.)

Patent Document 1: JP 2001-315483

Patent Document 2: JP 2004-50694

DISCLOSURE OF INVENTION

Problems to be Solved by the Invention

The problems to be solved are that in a liquid supply device provided with a liquid storage chamber and reservoir chamber, the gas-liquid exchange sensitivity is made excellent to supply the liquid to a liquid applying portion stably, while a change in the liquid storage amount in the liquid storage portion is reduced even when the temperature varies, the position is varied and the like.

Means for Solving the Problem

A liquid supply device of the invention is characterized by a structure where the liquid is hard to flow from the liquid storage chamber storing the liquid into a reservoir chamber. Further, the liquid supply device of the invention is characterized by a structure where an ink absorbing material is provided in the reservoir chamber, a seal by ink membrane is there by formed in the reservoir chamber, and by the seal effect, a large amount of ink is hard to flow into the reservoir chamber.

ADVANTAGEOUS EFFECT OF THE INVENTION

According to the liquid supply device of the invention, it is possible to reduce a change in the liquid storage amount in a liquid storage chamber even when the temperature varies, the position is varied and the like, while making the gas-liquid exchange sensitivity excellent to supply the liquid stably to a liquid applying portion.

BRIEF DESCRIPTION OF DRAWINGS

FIG. 7(*b*) is a cross-sectional view taken along line A-A of FIG. 7(*a*);

FIGS. 12(*b*) and 12(*c*) are cross-sectional views each taken along line I-I of FIG. 12(*a*);

BRIEF DESCRIPTION OF SYMBOLS

Figure 1:
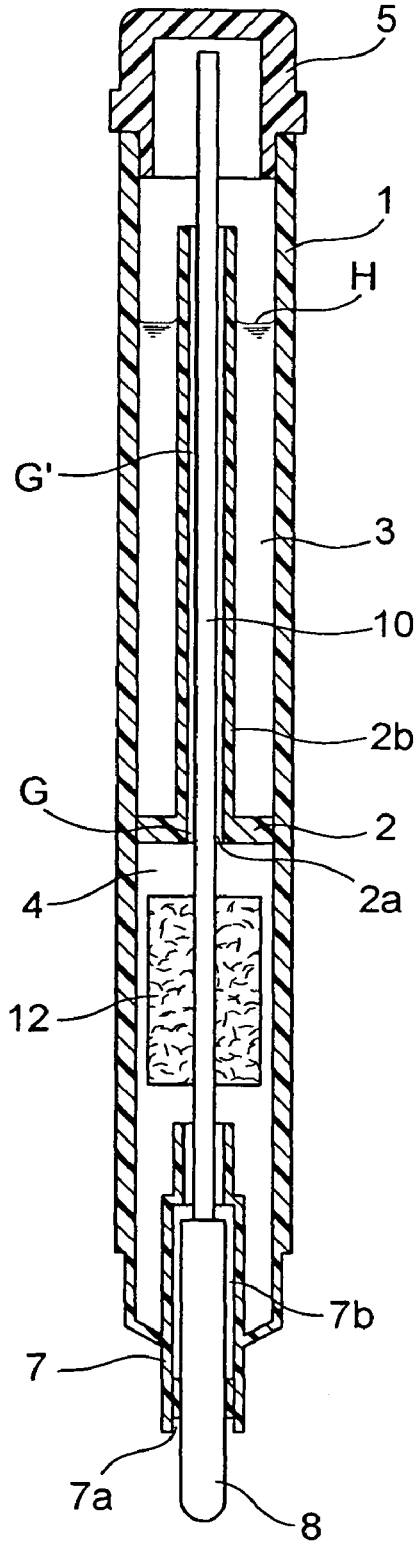
FIG. 1 is a view showing Embodiment 1 of the invention.

1 Main body
2 Partition
2*b* Partition extending portion
3 Ink storage chamber (Liquid storage chamber)
5 Tail plug
8 Application material
10 Relay core
12, 40 Ink absorbing material
15 Holding material
30 Partition
60 Brush (Application material)
70, 80 Rubber member (Application material) G, G' Gap

BEST MODE FOR CARRYING OUT THE INVENTION

Embodiments of the invention will specifically be described below with reference to accompanying drawings.

Figure 2:
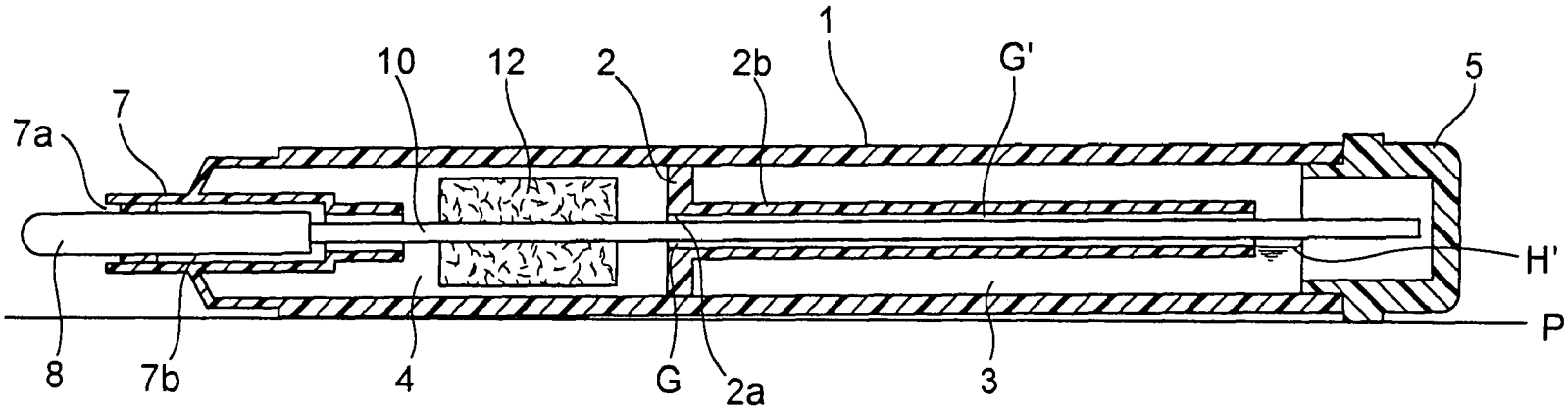
FIG. 2 is a view showing the writing instrument in a horizontal position of Embodiment 1 of the invention.

FIGS. 1 and 2 are views showing Embodiment 1 of the invention.

A liquid supply device of this Embodiment is configured as a writing instrument, and has a cylindrical barrel (main body) 1 with a hollow portion. The hollow portion of the main body 1 is divided into an ink storage chamber 3 that stores a liquid (ink), and a reservoir chamber 4 that receives the ink flowing out of the ink storage chamber 3 by a partition 2 disposed in the direction perpendicular to the axis direction. Further, to the tail side of the main body 1 is attached a cap-shaped tail plug 5 detachable to the main body 1, a tip piece 7 with an opening 7*a* is formed on the tip side, and an application material 8 is attached to the tip piece via an atmosphere communication hole 7*b* open to the reservoir chamber 4.

The partition 2 is obtained by press-fitting a disk-shaped member with an inner periphery of the main body 1, and a through hole 2*a* is formed in the center portion of the partition 2. A slender relay core 10 is inserted into the through hole 2*a* with a predetermined gap G (a gap of the extent to which the ink can be held by caterpillar force). In this case, the relay core 10 is obtained by collecting and compressing a number of fibers parallel with the axis direction, thus is formed as a porous rod-shaped member, and enables the ink to flow into and out of the rear end face and outer periphery thereof. Further, the relay core 10 is formed so that the pore rate is as low as possible not to exchange the gas and liquid therein (not to form an air passage) so as to supply the ink stored in the ink storage chamber 3 to the application material with high sensitivity by capillary force.

The partition 2 is provided with a partition extending portion 2*b* which extends to the liquid storage chamber 3 side along the relay core 10, while having a gap G' to maintain the predetermined gap G toward the tail plug 5 side. In this Embodiment, the liquid is held over the entire area of the gap G to gap G' by capillary force. In this case, the partition extending portion 2*b* may be integrally formed with the same material as that of the partition, or may be integrally formed with a different member. Accordingly, the ink inside the ink storage chamber 3 is stored by the outer surface of the partition extending portion 2*b* and the bottom of the partition 2, and does not leak to the reservoir chamber.

The relay core 10 is coupled at its tip to the application material 8, and protrudes at its rear end side inside the ink storage chamber 3 (protrudes inside the tail plug 5) from the rear opening of the partition extending portion 2*b*. By this means, the ink stored in the liquid storage chamber 3 flows into the application material 8 from the outer periphery and rear end face of the relay core 10, and thus is capable of being supplied to the application material 8. In addition, the relay core 10 is preferably configured to be positioned and held at a predetermined portion in the axis direction, for example, by forming positioning portions (for example, rib-shaped members coming into contact with the outer periphery of the relay core 10) at predetermined intervals in the axis direction inside the partition extending portion 2*b*. Alternately, the relay core 10 may be positioned by forming the partition extending portion 2*b* of cross section in the shape of an ellipse or polygon, and inserting the relay core 10 of circular cross section into the portion 2*b*.

The partition extending portion 2*b* is formed to be higher than a liquid surface H of the ink stored in the ink storage chamber 3 when the application material 8 is pointed downward. In other words, the ink stored in the ink storage chamber 3 is set to be in a position lower than the rear end opening of the partition extending portion 2*b* when the application material 8 is pointed downward. That is, when a large amount of ink is stored and the liquid surface H is in a position higher than the rear end opening of the partition extending portion 2*b*, in the case where the temperature increases with the application material 8 pointed downward and the like, the ink held by the gaps G and G' and the ink existing above the partition extending portion 2*b* all flows into the reservoir chamber 4 with ease. Therefore, for example, when a number of writing instruments are placed in over-the-counter sales and the like, the ink storage amount may differ for each writing instrument.

However, as described above, when the liquid surface H is in a position lower than the rear end opening of the partition extending portion 2*b*, even when the temperature increases with the application material pointed downward, only the ink held by the gaps G and G7' flows into the reservoir chamber 4, and the ink beforehand stored in the ink storage chamber 3 is confined by the bottom of the partition 2, and does not flow into the reservoir chamber 4. Accordingly, the occurrence of a large change in the ink storage amount is suppressed in each writing instrument.

In addition, the above-mentioned writing instrument is considered actually undergoing various changes in its position for a period during which the instrument is manufactured and placed for over-the-counter sales, and not always in the position that the application material 8 side is pointed downward. Among positions, the case that the ink inside the ink storage chamber 3 flows into the reservoir chamber 4 most is that the writing instrument is laid over a horizontal plane P as shown in FIG. 2. Accordingly, an amount of ink stored in the ink storage chamber 3 is adjusted to be less than a line H' passing through the lowest inner periphery portion defining the gap G' of the partition extending portion 2*b* with the main body 1 placed in a horizontal position. By this means, the ink does not flow into the reservoir chamber 4 even when the temperature increases, and it is possible to maintain the ink storage amount of each writing instrument substantially constant.

Further, as shown in the figure, inside the reservoir chamber 4 is preferably provided an ink absorbing material 12 that comes into contact with the outer periphery of the relay core 10 and that is able to contain and hold the liquid. Such an ink absorbing material 12 is configured using a porous material (cotton and the like) such as a fiber material and the like, for example. By providing such an ink absorbing material 12 in the reservoir chamber 4, it is possible to hold the ink flowing out of the gaps G and G' to prevent the ink from leaking from the atmosphere communication hole 7*b*, while returning the absorbed ink to the relay core 10 (to reuse in writing). As a matter of course, a structure without proving such an ink absorbing material 12 may be applied.

In addition, the ink absorbing material 12 as shown in the figure is provided to cause a gap with the inner periphery of the main body 1, and the atmosphere flows into the gaps G and G' through the gap. Accordingly, the ink absorbing material 12 with such a structure does not have the gas-liquid exchange action.

The writing instrument with the above-mentioned structure is in a state where an ink membrane (seal) is formed by capillary force in the gap G between the inner periphery wall of the through hole 2*a* formed in the partition 2 and the outer periphery of the relay core 10 impregnated with the ink, and in the gap G' between the inner periphery wall of the partition extending portion 2*b* and the outer periphery of the relay core 10. The ink membrane breaks due to an increase or decrease in the pressure inside the ink storage chamber 3, and the so-called gas-liquid exchange action is obtained such that the ink flows into the reservoir chamber 4, the air flows into the ink storage chamber 3 via the reservoir chamber 4 communicated with the atmosphere, and the like. Further, when the ink is consumed by writing, the ink held by capillary force is sucked and supplied to the application material 8.

More specifically, when writing is performed using the application material 8, the ink impregnated in the relay core 10 is consumed, while the ink is consumed that is held in the gaps G and G' between the outer periphery of the relay core 10 and the inner periphery wall of each of the through hole formed in the partition 2 and the partition extending portion 2*b* continuing from the partition 2. Then, when the ink held by the gaps G and G' is consumed, since the gas corresponding to the consumed ink flows into the gaps for gas-liquid exchange, the sensitivity of gas-liquid exchange becomes excellent, and it is possible to perform stable writing continuously without the occurrence of a thin spot and the like. Accordingly, for example, as compared with a structure where a relay core is fitted with a through hole formed in a partition without a gap to perform gas-liquid exchange inside the relay core, or to perform gas-liquid exchange in a position spaced apart from the relay core, the gas-liquid exchange sensitivity becomes excellent, and it is possible to perform stable application work continuously. In addition, generally, since sufficient writing can be performed only by the ink impregnated in the relay core 10, a case is rare that the ink held by the gaps G and G' is consumed. Particularly, in a writing instrument such as a board marker, since writing is performed with the rear end side pointed downward and the ink is always brought into contact with the relay core 10, the ink impregnated in the relay core 10 is consumed.

Further, the ink stored in the ink storage chamber 3 is spaced apart from a portion where gas-liquid exchange is performed by the partition 2 and partition extending portion 2*b*, it is thereby possible to eliminate the effects of changes in temperature (changes in pressure) and head pressure, and the ink can be discharged stably.

Then, in actually performing writing, as described above, the ink held in the relay core 10, and gaps G and G' is consumed, and when the ink of these portions is all consumed, there is no ink to supply to the relay core 10. In this case, by changing the position of the writing instrument, for example, pointing the tail plug 5 side downward once and the like, the ink stored in the ink storage chamber 3 is allowed to be held again in the gaps G and G'.

Further, in the writing instrument with the above-mentioned structure, the ink storage chamber 3 is not divided into a plurality of small chambers as disclosed in the above-mentioned Patent Document, but comprised of a single chamber, and the effects are obtained as described below.

For example, when pigment-based ink (mixture of solvent and pigment) is used as the ink, since the solvent and pigment are apt to separate, it is necessary to store a spindle and the like for mixing in the ink storage chamber. In this Embodiment, since the ink storage chamber is not divided into a plurality of chambers, only one spindle needs to be stored, and it is possible to reduce the cost. Further, since the need is eliminated of providing partitions to divide the ink storage chamber into a plurality of chambers, and another need is also eliminated of providing a plurality of gas-liquid exchange portions, the number of parts decreases, the assembly is easy, the cost is reduced, and dimensional control is not complicated.

Figure 3:
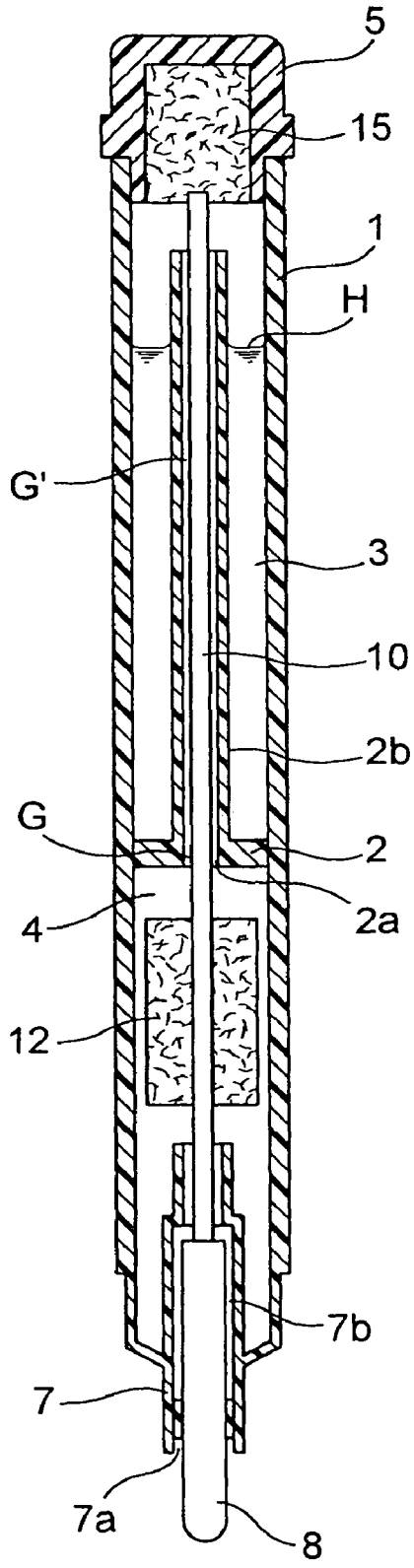
FIG. 3 is a view showing Embodiment 2 of the invention.

FIG. 3 is a view showing Embodiment 2 of the invention.

In this Embodiment, in the structure of the above-mentioned Embodiment, a porous holding material 15 to hold the ink inside the ink storage chamber 3 is provided on the rear end side of the relay core 10. In this case, the rear end face of the relay core 10 is positioned inside the holding material 15, and the ink is capable of mainly flowing into the core 10 from the rear end face.

According to such a structure, even when the ink held by the above-mentioned gaps G and G' is consumed by writing, the relay core 10 is capable of supplying the ink held in the holding material 15 to the application material 8. Accordingly, as compared with the structure where the holding material 15 is not provided, without frequently changing the position as described above, it is possible to perform continuous writing.

Figure 4:
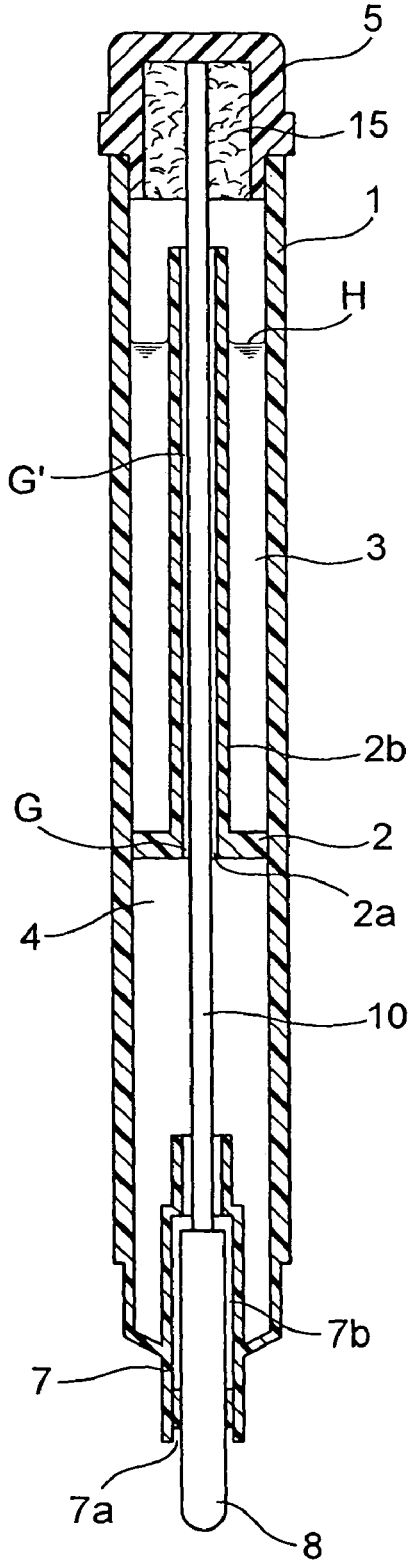
FIG. 4 is a view showing Embodiment 3 of the invention.

FIG. 4 is a view showing Embodiment 3 of the invention.

In this Embodiment, the rear end side of the relay core 10 is inserted into the holding material 15, while the rear end face is brought into contact with the inner surface of the tail plug 5, and blockage processing is thereby performed on the rear end portion.

The relay core 10 is obtained by collecting fibers in the vertical direction as described above, and thus has characteristics that the ink is easy to flow in the vertical direction, but hard to flow into the core 10 from the diameter direction. As described above, by performing the blockage processing on the portion through which the ink is easy to flow, the ink held by the holding material 15 flows from the diameter direction. Accordingly, when the ink of the ink holding material 15 is saturated, it is possible to suppress an amount of ink flowing inside the relay core 10, and to decrease an amount of ink flowing into the application material 8 (an ink-rich state is suppressed in the application material 8.)

In addition, whether or to perform the blockage processing on the rear end portion (including the rear end face) of the relay core 10 is determined corresponding to the type of ink to use and the like. Further, also in this Embodiment, as in the above-mentioned Embodiment, the ink absorbing material 12 may be disposed in the reservoir chamber 4.

Figure 5:
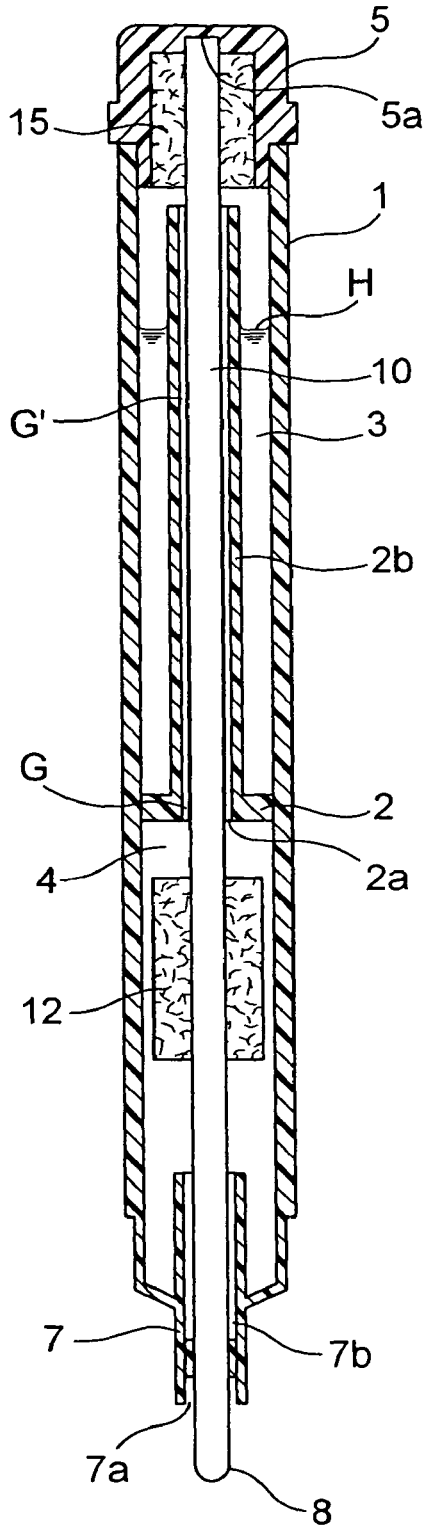
FIG. 5 is a view showing Embodiment 4 of the invention.

FIG. 5 is a view showing Embodiment 4 of the invention.

In this Embodiment, a concave portion 5*a* is formed in a center portion of the tail plug 5, the rear end portion of the relay core 10 is fitted with the concave portion 5*a*, and the blockage processing is thereby performed on the rear end portion of the relay core 10. Thus, the method of performing the blockage processing on the rear end portion of the relay core 10 is capable of being modified as appropriate, and as well as the above-mentioned structure, it is possible to block the portion by coating a resin on the rear end face of the relay core 10, melting the rear end face and the like.

Further, in this Embodiment, the application material 8 and relay core 10 are formed integrally. By thus forming integrally the application material 8 and relay core 10 that are members which the ink flows into, it is possible to decrease the number of parts, and to reduce the cost. In addition, the ink absorbing material 12 and holding material 15 may be formed integrally with the relay core 10.

Figure 6:
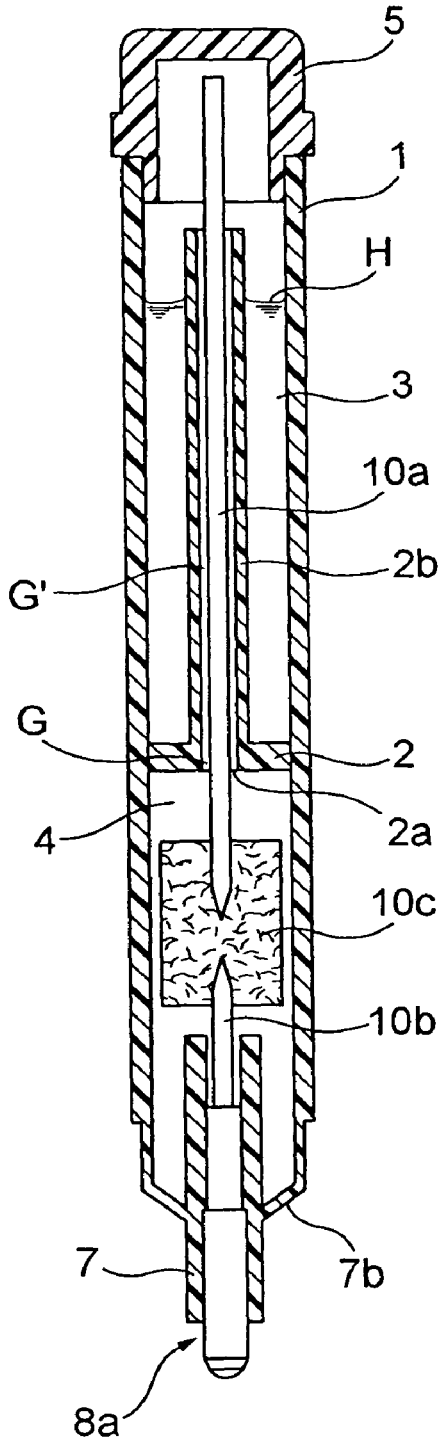
FIG. 6 is a view showing Embodiment 5 of the invention.

FIG. 6 is a view showing Embodiment 5 of the invention.

In this Embodiment, the above-mentioned relay core 10 is divided into two or more (two, in this Embodiment) cores in the axis direction, and the divided cores are disposed on the same axis, respectively referred to as a storage-chamber side relay core 10*a* and application material side relay core 10*b*, and connected to a relay absorbing material 10*c* capable of containing and holding the ink. The application material side relay core 10*b* is provided with, for example, a ball chip, connected to an application material 8*a* having a valve function, and exerts a predetermined head pressure (about 20 mm) on the application material 8*a*.

Generally, such an application material provided with the ball chip makes the diameter of the relay core small, and it becomes difficult to position and insert the relay core accurately in the main body to incorporate. Therefore, with respect to the structure of the relay core, as in this Embodiment, the relay core may be divided in the axis direction to be incorporated into the main body 1, and when the core is divided, by connecting divided cores via an absorbing material that holds the ink, it is possible to perform dimensional control easily.

In addition, as shown in this Embodiment, as long as the atmosphere communication hole 7*b* is opened inside the reservoir chamber 4, the position thereof is capable of being changed as appropriate. Further, as in the above-mentioned Embodiment, the ink absorbing material 12 may be disposed in the reservoir chamber 4.

Figure 7A:
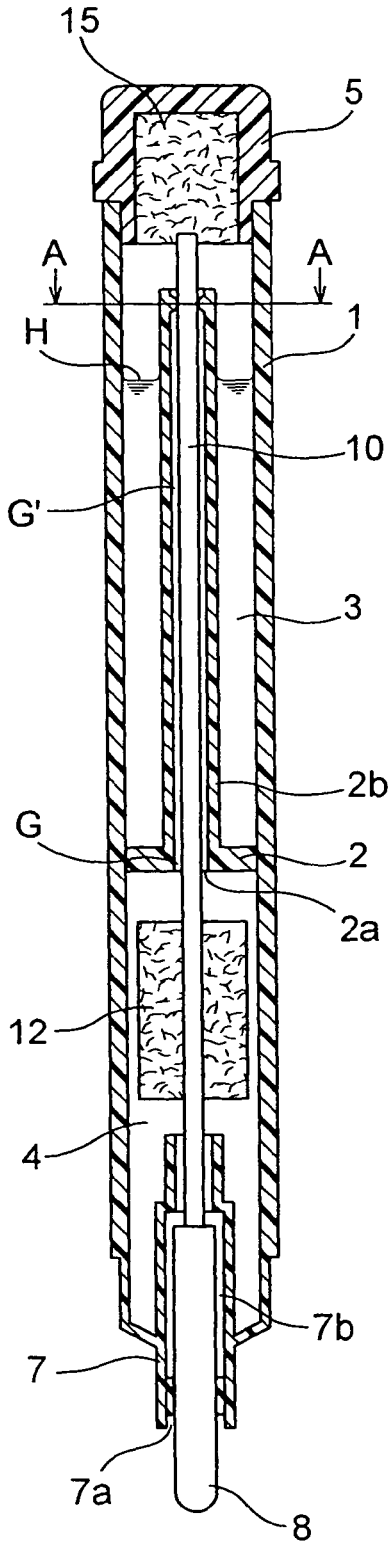
FIG. 7(*a*) is a view showing Embodiment 6 of the invention.
Figure 7B:
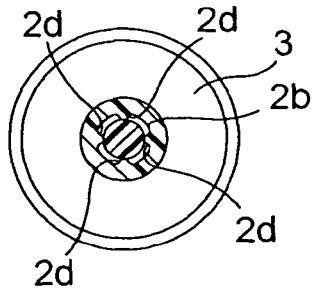

FIG. 7 is a view showing Embodiment 6 of the invention.

In this Embodiment, contact portions 2*d* are formed inside the partition extending portion 2*b* to be brought into contact with the outer periphery of the inserted relay core 10 at two or more portions. The contact portions of this Embodiment are formed in the shape of ribs, come into contact with the outer periphery of the relay core 10 at four portions spaced substantially 90° from one another, and are configured to determine the position of the relay core 10, while causing the ink to be hard to flow into the gaps G and G' when the position is changed.

As described above, the ink inside the gaps G and G' is held by relatively weak caterpillar force (weaker than the caterpillar force inside the holding material 15), and consumed by writing of the application material 8. In this case, when the temperature increases (the pressure increases), the held ink easily flows into the reservoir chamber 4 although the amount is very small (without making the application material 8 ink-rich). Therefore, considering that the ink held in the holding material 15 can be supplied to the application material 8 by writing, it is desirable that the ink held in the holding material 15 is mainly used to supply the ink to the application material 8 so as to reduce the flow (flow of the ink held in the gaps G and G') to the reservoir chamber 4 as much as possible.

As described above, by forming the contact portions 2*d* inside the partition extending portion 2*b*, since the ink becomes hard to flow into the gaps G and G' even when the position is changed, it is possible to reduce an amount of ink flowing into the reservoir chamber 4 as much as possible when the temperature increases (the pressure increases).

In addition, such contact portions are simply required to come into contact with the outer periphery of the relay core at two or more portions for positioning of the relay core 10, and are preferably in a shape of causing the ink to be hard to flow into the gaps G and G'.

Figure 8:
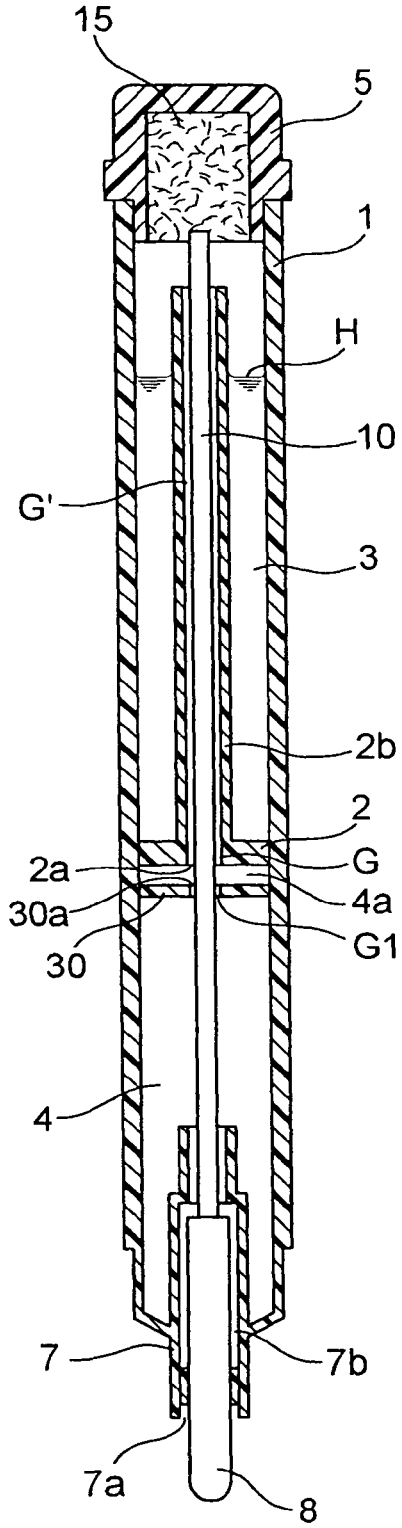
FIG. 8 is a view showing Embodiment 7 of the invention.

FIG. 8 is a view showing Embodiment 7 of the invention.

In this Embodiment, a second partition 30 is disposed inside the reservoir chamber 40. In the center portion of the partition 30 is formed a through hole 30*a* into which the relay core is inserted. As in the partition 2, the partition 30 is configured to form a similar gap G1 with the outer periphery of the inserted relay core 10 to generate a seal membrane by ink in the gap.

Thus, by providing the second partition 30 in the reservoir chamber 4, the portion of the gap G1 is always sealed by the ink membrane, and it is thereby possible to prevent the ink in the gaps G and G' from shifting to the reservoir chamber 4 in changing the position and the like. Further, when the ink in the gaps G and G' flows into the reservoir chamber 4 due to an increase in temperature with the writing instrument laid horizontally, the flowing ink is held in a newly formed reservoir chamber 4*a* (space between the second partition 30 and partition 2). Then, the ink held therein is capable of coming into contact with the relay core 10 inside the narrow space, and thus consumed reliably by writing of the application material 8. Inversely, in a structure without such a second partition 30, the ink flowing into the reservoir chamber 4 is used hardly in application, and left in the reservoir chamber 4. Alternately, even when the ink absorbing material 12 is provided in the reservoir chamber 4, the ink absorbed by the ink absorbing material 12 is held by capillary force, and is difficult to be used completely in application.

In addition, in such a structure with the second partition 30 provided, the ink absorbing material 12 may be further disposed between the second partition 30 and application material 8. In other words, when the ink flows out of the gap G1 portion of the second partition 30 due to an increase in temperature and the like, it is possible to hold the ink.

Figure 9:
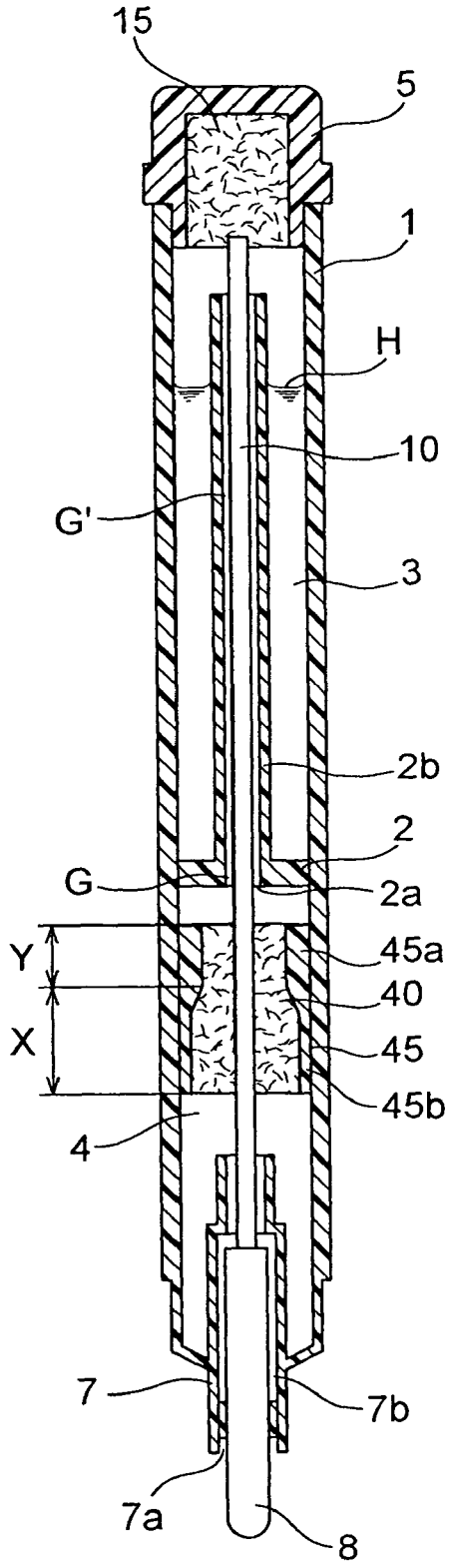
FIG. 9 is a view showing Embodiment 8 of the invention.

FIG. 9 is a view showing Embodiment 8 of the invention.

In this Embodiment, an ink absorbing material 40 is disposed in the reservoir chamber 4, and it is configured that the pore rate of the ink absorbing material 40 differs in the axis direction.

More specifically, a tube-shaped ink absorbing material 40 made of a single material is fitted with a holder 45 fastened to the inner surface of the main body 1, while the holder 45 is provided with a small diameter portion 45*a* and a large diameter portion 45*b*, it is thus configured that the pore rate of the ink absorbing material 40 is varied with a simple structure, and the small diameter portion 45*a* (with strong compression force and the low pore rate of the ink absorbing material 40; a region shown by symbol Y) is disposed on the partition 2 side, while the large diameter portion 45*b* (with weak compression force and the high pore rate of the ink absorbing material 40; a region shown by symbol X) is disposed on the application material 8 side. Then, in such a structure, the relationship of the pore rate between the ink absorbing material and relay core 10 (including the application material 8) passed through the ink absorbing material 40 is set that the pore rate of the application material 8<the pore rate of the relay core 10<the pore rate of the region Y<the pore rate of the region x (as the pore rate is higher, more air passages are contained and the capillary force is weaker.)

The reason why the pore rates of the application material 8 and relay core 10 are set lower than the pore rate of the absorbing material 40 is not to pass the air through the inside so as to supply the ink on the ink storage chamber side promptly to the application material. Then, the following phenomenon is obtained by forming the regions X and Y with different pore rates along the axis direction, as described above, in the ink absorbing material 40 with the pore rate higher than the pore rates of the application material 8 and relay core 10.

When the ink in the gaps G and G' and ink in the ink storage chamber flows into the reservoir chamber 4 by an increase in temperature and the like, the ink is held in the region Y with the low pore rate (strong capillary force). In this case, even when the temperature increases continuously for a long time, an amount of ink shifting from the region Y to region X is small because the capillary force is weaker in the region X than in the region Y (while the ink shifts to a region with the locally high capillary force in the region X). Then, in the region Y, the ink is saturated and a seal state by the ink is formed. In other words, when a holing amount of the ink is saturated in the region Y, the ink further trying to flow into is not absorbed by the region Y, and the ink more than such an amount is hard to flow out of the ink storage chamber (a space portion between the ink absorbing material 40 and partition 2 functions as a dumper). In addition, the ink trying to flow out tends to flow into the space portion between the ink absorbing material 40 and partition 2, and the portion with the strong capillary force in the region X. An amount of such ink is very small, and when the portion of the region Y is saturated with the ink, the ink does not flow any more from the ink storage chamber 3 side to the reservoir chamber side (if the ink flows, an amount of the ink is very small) even when the temperature increases or the position is changed.

Accordingly, in filling the ink storage chamber 3 with the ink in an earlier stage, by containing the ink in the region Y with the low pore rate of the ink absorbing material 40 to be saturated, the ink does not flow from the ink storage chamber 3 side to the reservoir chamber 4 in subsequent stages even when the temperature increases or the position is changed, and it is thereby possible to suppress reliably the occurrence of changes in ink storage amount for each writing instrument.

As a result, even when the writing instrument undergoes changes in temperature and/or various changes in position for a period during which the instrument is manufactured and sold in over-the-counter sales, since the portion of the region Y is beforehand saturated with the ink, the portion is in a state where the seal is formed by the ink, and the ink in the ink storage chamber 3 does not flow into the reservoir chamber 4 and maintained at a predetermined level. Accordingly, when a long time has elapsed since the manufacturing, for all the writing instruments, the apparent ink storage amount accommodated in the ink storage chamber 3 is kept constant, and trouble does not occur, for example, such that the ink amount inside the ink storage chamber is different from one another.

Then, when the application material 8 is actually used to write, consumed is not only the ink held in the gaps G and G', but also the ink held in the region Y of the ink absorbing material 40, the ink existing between the ink absorbing material 40 and partition 2, or the ink held in the holding material 15. More specifically, when the ink is contained in the region X, the gas-liquid exchange action is carried out such that the ink in the region X is consumed while the air flows into, the ink in the region Y is next consumed while the air flows into, the ink between the ink absorbing material 40 and partition 2 is next consumed while the air flows into, and that the ink held in the gaps G and G' is next consumed while the air flows into. In other words, the ink in the portions as well as the gaps G and G' is effectively used in application, and therefore, as compared with Embodiment 1 as described above, it is possible to further decrease the frequency of position change to resolve the ink-poor state of the application material 8 in writing (it is possible to increase the distance enabling writing without changing the position.) In addition, the region X of the ink absorbing material 40 exhibits the effect of holding the ink flowing onto the surface portion of the relay core 10, or absorbing part of the ink saturated in the region Y, i.e. the so-called "containing" effect during application of the application material 8, and also has the function of effectively suppressing the ink-rich state of the application material 8.

Further, as described above, in the structure that the ink absorbing material 40 is separated into the region with the strong capillary force and the region with the weak capillary force, the predetermined gaps G and G' may be set at a volume to the extent of not holding the ink by capillary force. In other words, also in a structure where the ink in the ink storage chamber 3 freely flows into the reservoir chamber 4 without being held in the predetermined gaps G and G' by capillary force, it is possible to suppress variations in the amount of ink in the ink storage chamber 3 by the seal effect in the region Y.

Figure 10:
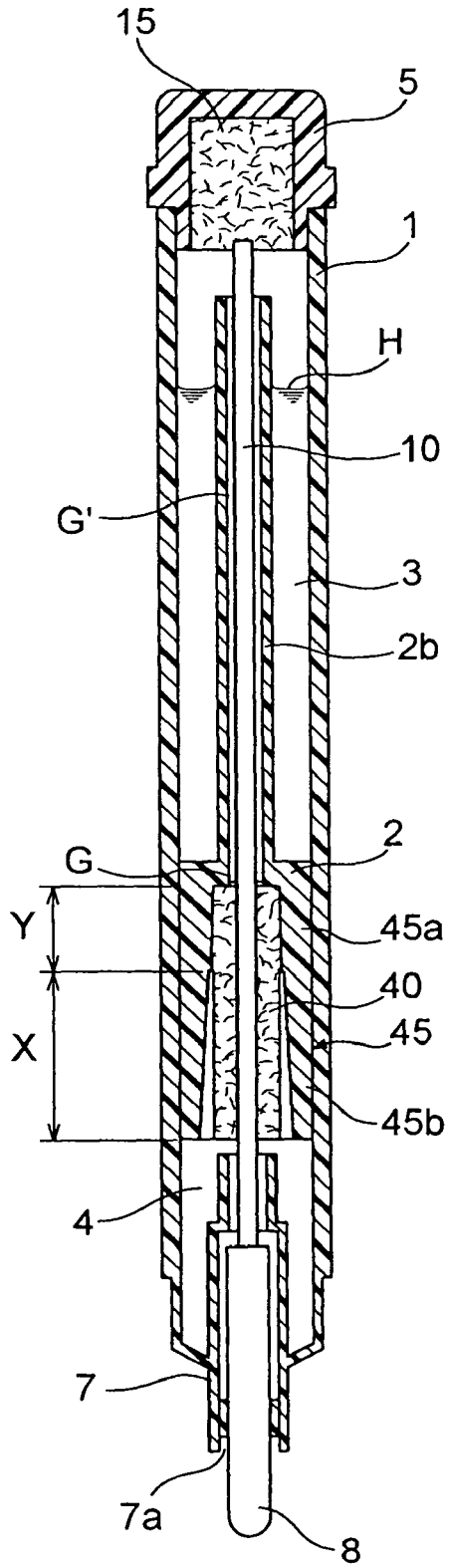
FIG. 10 is a view showing Embodiment 9 of the invention.

FIG. 10 is a view showing Embodiment 9 of the invention.

In this Embodiment, the holder 45 in above-mentioned Embodiment 8 is formed integrally with the partition 2, and the ink absorbing material 40 with the low pore rate in the small diameter portion 45*a* is directly brought into contact with the gap G. Further, the inner surface of the holder 45 holding the ink absorbing material 40 is tapered in the small diameter portion 45*a* and large diameter portion 45*b* for changing the pore rate, and it is thus configured to change the pore rate of the ink absorbing material 40 continuously in the axis direction.

Also in such a structure, in the region Y where the pore rate of the ink absorbing material 40 is relatively low, it is possible to exhibit the seal effect by ink as described above, and in the saturated state, it is possible to prevent the ink from flowing from the ink storage chamber 3 to reservoir chamber 4.

In addition, it is possible to modify as appropriate the structure of the holder 45 to change the pore rate of the ink absorbing material 40 of a single structure as described above. For example, as in Embodiment 10 shown in FIG. 11, the structure may be obtained by forming the material 40 integrally with the partition 2 and changing the inner diameter of the holder in stages. Alternately, without using the ink absorbing material of a single structure as in the above-mentioned Embodiment, a plurality of ink absorbing materials with different pore rates may be disposed adjacent to one another in the axis direction.

Figure 12A:
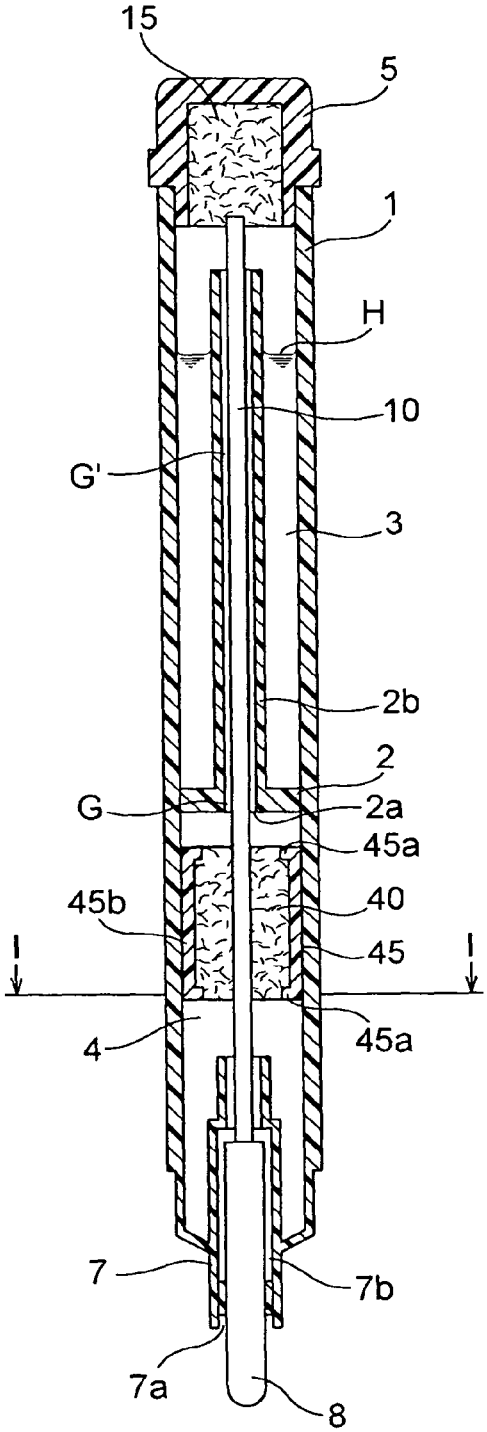
FIG. 12(*a*) is a view showing Embodiment 11 of the invention.
Figure 12B:
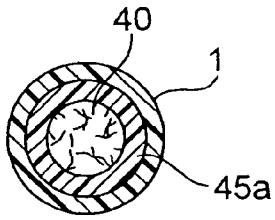
Figure 12C:
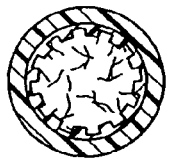

FIG. 12(*a*) is a view showing Embodiment 11 of the invention.

In this Embodiment, as means for changing the pore rate of the ink absorbing material 40 of a single structure as descried above, small diameter portions 45*a* are formed in opposite end portions in the axis direction of the holder 45. In other words, each of the small diameter portions 45*a* has a higher pressing force toward the center direction than that in the other portion, and thus is a region where the pore rate is low along the diameter direction. The region except the portions 45*a* is a region where the pore rate is high along the diameter direction.

Thus, by providing the region where the pore rate is low along the diameter direction in at least two or more portions in the axis direction, it is possible to further increase the seal effect by the ink membrane, and to more effectively suppress ink leakage to the application material 8. In other words, in the Embodiment as shown in FIG. 9, when a large amount of ink flows into the ink absorbing material 40 by rapid increases in temperature and the like, the ink flows into the region X with the high pore rate, and it is considered that the entire ink absorbing material 40 is saturated later. In contrast thereto, by providing the region where the pore rate is low along the diameter direction in at least two or more portions in the axis direction, when the ink flows into the reservoir chamber, the ink first flows into each of the regions with the low pore rate (region with the strong capillary force) to form the seal by the ink membrane, and becomes hard to flow into the region with the high pore rate that is a middle portion between the regions by the seal effects formed on the opposite sides, and the entire ink absorbing material 40 becomes hard to be saturated.

In addition, in the above-mentioned structure, the small diameter portion 45*a* to decrease the pore rate may be configured as a rib extending toward the center portion over the circumference direction as shown in FIG. 12(*b*). Alternately, as shown in FIG. 12(*c*), the portion 45*a* can be configured by forming a plurality of ribs extending toward the center portion at predetermined intervals to decrease the pore rate along the diameter direction.

Figure 13A:
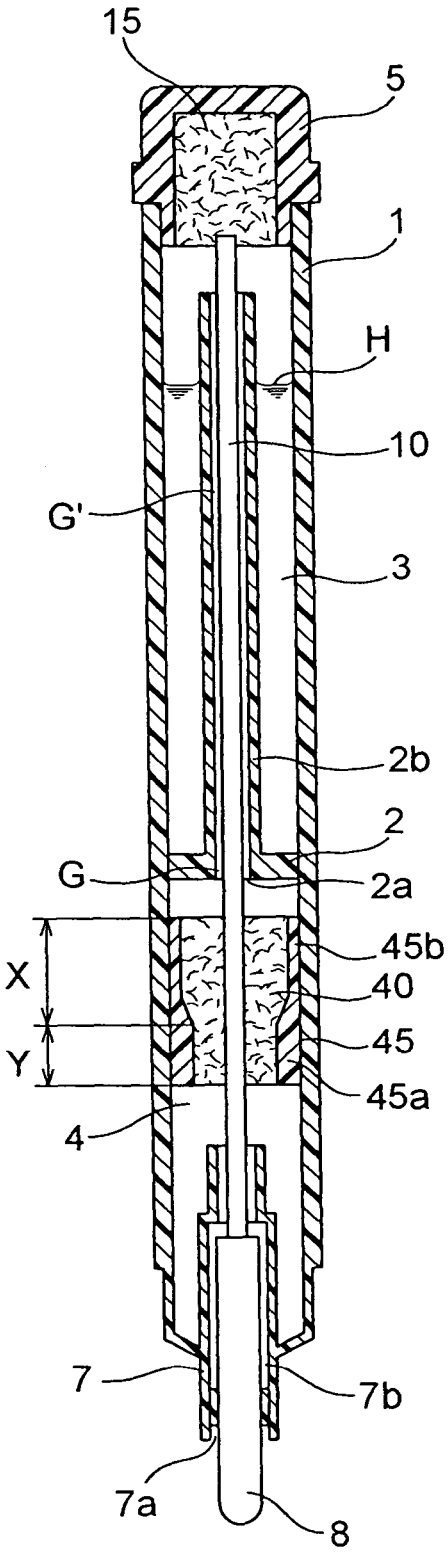
FIGS. 13(*a*) and 13(*b*) are views each showing Embodiment 12 of the invention.
Figure 13B:
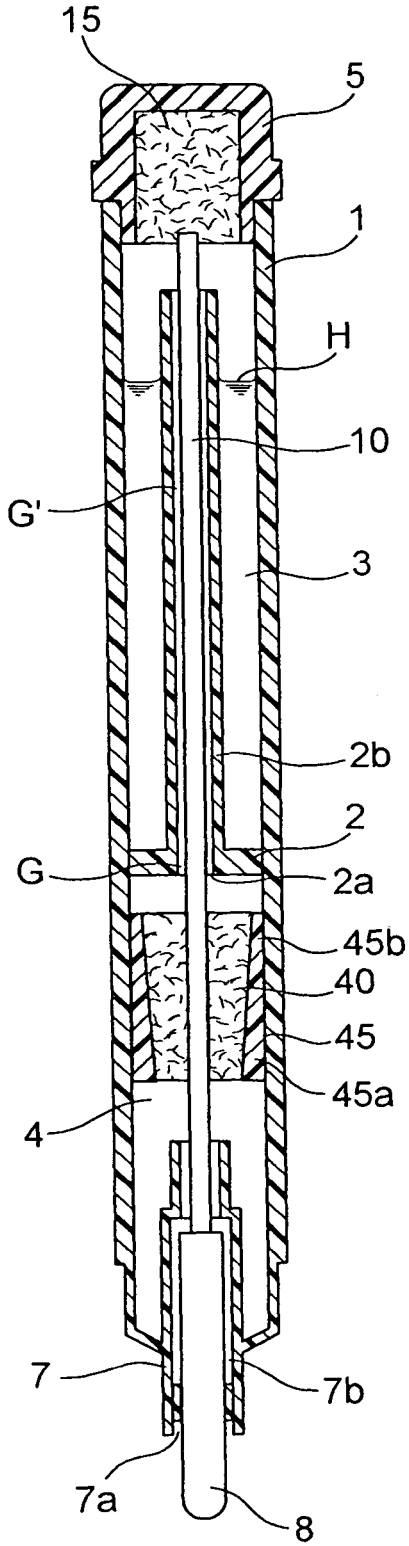

FIGS. 13(*a*) and 13(*b*) are views showing Embodiment 12 of the invention.

Figure 11:
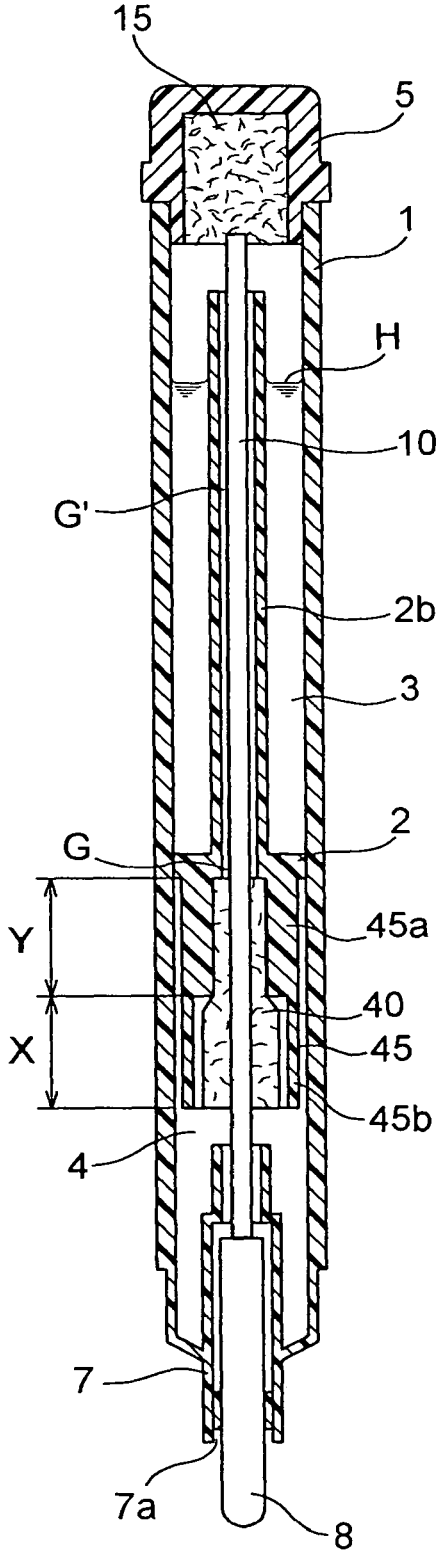
FIG. 11 is a view showing Embodiment 10 of the invention.

In this Embodiment, inversely to the Embodiments as shown in FIGS. 9 to 11 as described above, the ink absorbing material 40 is set so that the pore rate is low on the application material 8 side. In other words, by forming the small diameter portion 45*a* on the application material 8 side of the holder 45 (FIG. 13(*a*)), or forming a tapered portion 45*a* reducing the diameter gradually on the application material 8 side (FIG. 13(*b*)), the pore rate on the application material 8 side is set to be low in the ink absorbing material 40.

By configuring in such a way, as well as obtaining the same effects as in the Embodiments shown in FIGS. 9 to 11, following action and effects are obtained. Since a large amount of ink is stored in a position near the application material 8, even when quick writing is performed with the application material 8, the ink-poor state is hard to occur in the application material portion, and supply of ink to the application material can be followed even in quick writing, hardly causing a thin spot and the like. Further, since the seal by the ink membrane is formed on the application material 8 side, the ink in the application material 8 portion is hard to shift to the ink storage chamber 3 side even when the pressure on the ink storage chamber 3 side is reduced, and the ink-poor state is effectively avoided in the application material 8. This action is particularly effective when a pen material having a ball chip is used as an application material. In other words, the ink in a gap between the ball chip and the holder (chip holder) holding the chip becomes hard to shift to the ink storage chamber 3 side by the formed seal membrane, and it is made possible to effectively avoid trouble such that writing is disabled. In addition, in such a structure using the pen material having a ball chip, it is preferable that the chip holder and ink absorbing material are brought into contact with each other, and a portion with the pore rate set low is provided in the contact portion.

Figure 14A:
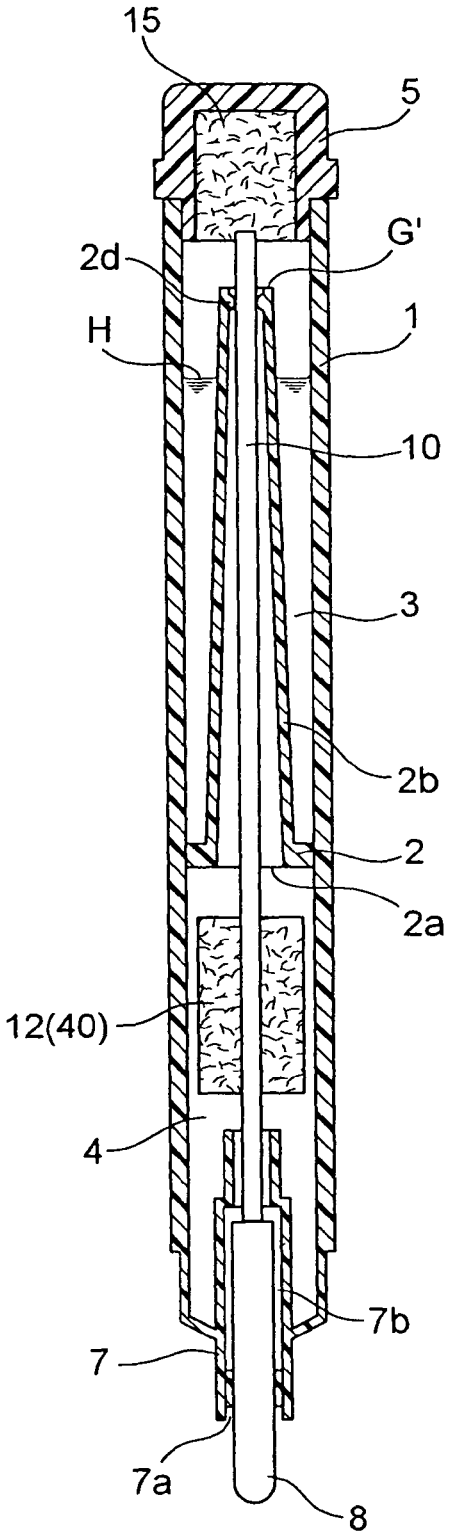
FIGS. 14(*a*) and 14(*b*) are views each showing Embodiment 13 of the invention.
Figure 14B:
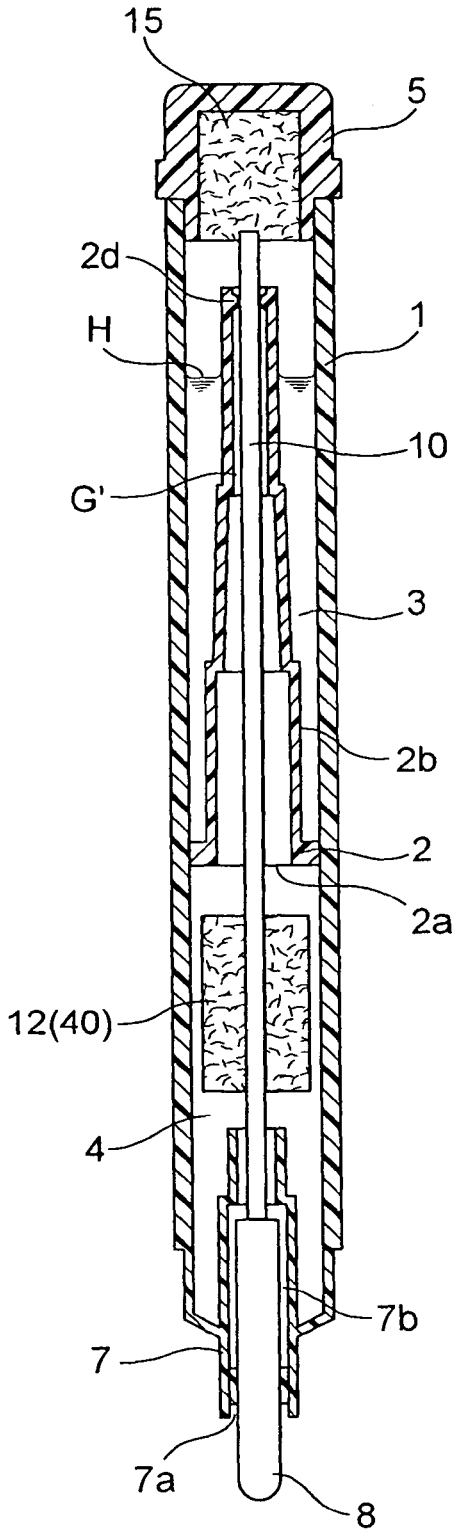

FIGS. 14(*a*) and 14(*b*) are views showing Embodiment 13 of the invention.

As shown in the figures, such a structure may be provided where the liquid is not held over the entire longitudinal direction of the partition extending portion between the relay core 10 and partition extending portion 2*b*. In other words, the liquid cannot flow into the reservoir chamber 4 originally by the partition 2 and partition extending portion 2*b* as described above, the head pressure does not act on the application material 8, and therefore, the seal by capillary force needs to be formed only in part of the partition extending portion 2*b*.

In addition, as in the structure shown in FIG. 14(*a*), the inner surface of the partition extending portion 2*b* is tapered not to hold the ink, while as shown in FIG. 7(*b*), the contact portion 2*d* is formed inside the tip, and the gap G' where the capillary force acts is formed in the end portion. In such a structure, as described above, since the ink is hard to flow into the gap G' even in changing the position, the ink is hard to flow into the reservoir chamber 4 when the temperature increases (the pressure increases). Further, in the structure as shown in FIG. 14(*b*), the inner surface of the partition extending portion 2*b* is formed in stages not to hold the ink, while the gap G' where the capillary force acts is formed on the end side, and the contact portion 2*d* as shown in FIG. 7(*b*) is formed in the tip portion. Also in such a structure, the ink is hard to flow into the gap G', and since the distance of the gap G' is longer than that in the structure as shown in FIG. 14(*a*), it is possible to increase the distance enabling writing without changing the posture.

Figure 15:
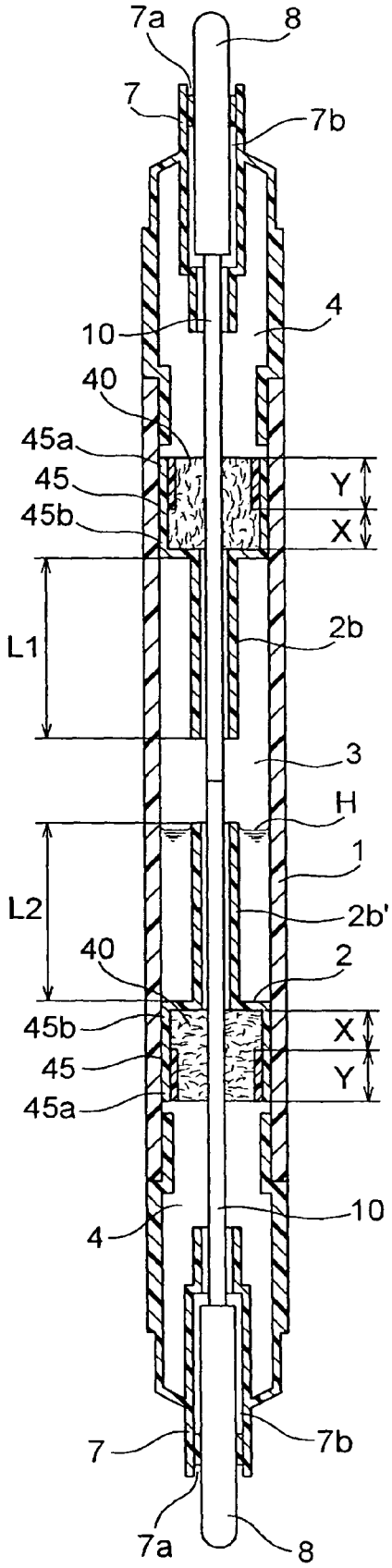
FIG. 15 is a view showing Embodiment 14 of the invention.

FIG. 15 is a view showing Embodiment 14 of the invention.

In this Embodiment, application materials 8 are inserted in opposite end portions of the axis barrel (main body) 1. In this case, the ink storage chamber provided in the axis barrel 1 may be formed corresponding to each of opposite application materials 8, but as shown in the figure, by providing a single ink storage chamber 3, it is possible to make timing substantially the same at which the ink cannot be applied by each of the opposite application materials 8.

Further, in such a structure, the partition extending portion 2*b* is set to be higher than the liquid surface H of the ink when pointing any one of the application materials 8 downward, and it is configured that the application material 8 portion is not acted upon by the head pressure of the ink stored in the ink storage chamber 3 when writing is performed using any one of the application materials 8. Further, each reservoir chamber 4 is provided with the ink absorbing material 40 that absorbs the ink as in the above-mentioned Embodiment.

In addition, in the above-mentioned both-head type of writing instrument, it is preferable that the length L1 of one partition extending portion 2*b* is longer than the length L2 of another partition extending portion 2*b*'. By providing such a structure, in first filling the ink storage chamber 3 with the ink, by filling the ink corresponding to the length L1, it is possible to secure a maximum ink storage amount. In other words, when the ink is stored in the amount corresponding to the length L1, the ink inside the ink storage chamber 3 decreases until each relay core 10 is impregnated with the ink subsequently and the seal of ink is formed in the ink absorbing material 40, and it is possible to finally set the liquid surface H corresponding to the partition extending portion 2*b*' short in the length.

Various modifications of the above-mentioned Embodiments will be described below.

Figure 16:
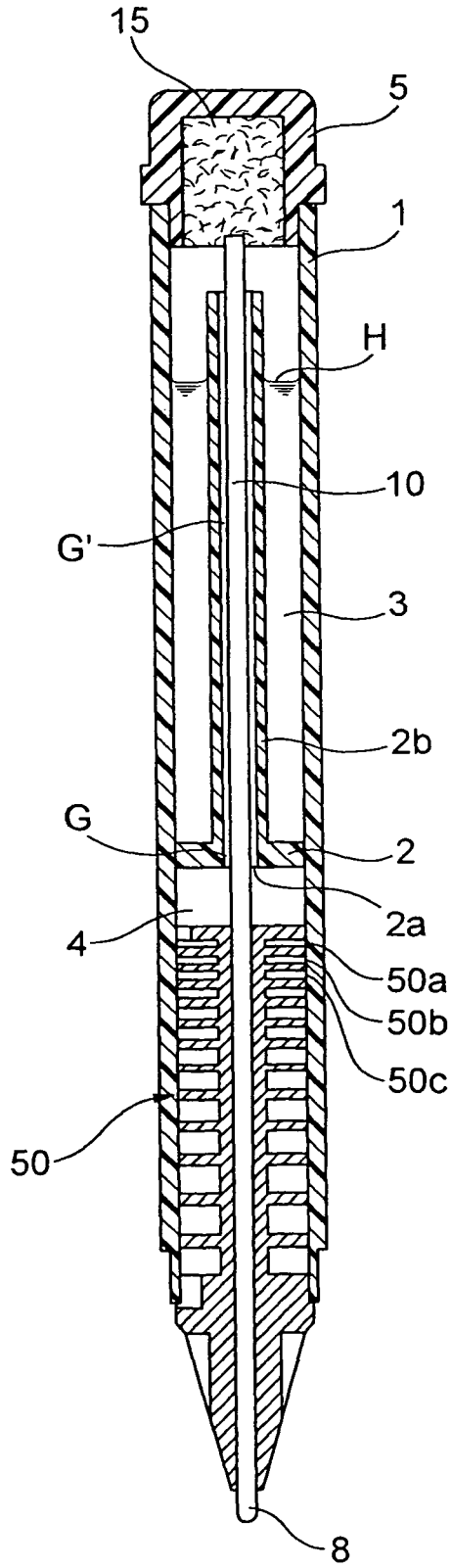
FIG. 16 is a view showing Modification 1 of the above-mentioned Embodiment.

As described above, for the ink absorbing material 12 (for example, see FIG. 3) disposed in the reservoir chamber 4, as well as the porous soft member comprised of a fiber material such as cotton and the like, for example, as shown in FIG. 16, the material 12 may be configured using a well-known hard ink holding material (feeder mechanism) 50 capable of holding the ink in gaps between members obtained by providing a plurality of disk-shaped members adjacent to one another along the axis direction. In this case, the ink flowing out is held successively in holding portions 50*a*, 50*b*, 50*c*, . . . becoming broader starting with the upper portion with a narrow gap.

Thus, it is possible to modify the structure of the ink absorbing material provided in the reservoir chamber 4 as appropriate.

Figure 17:
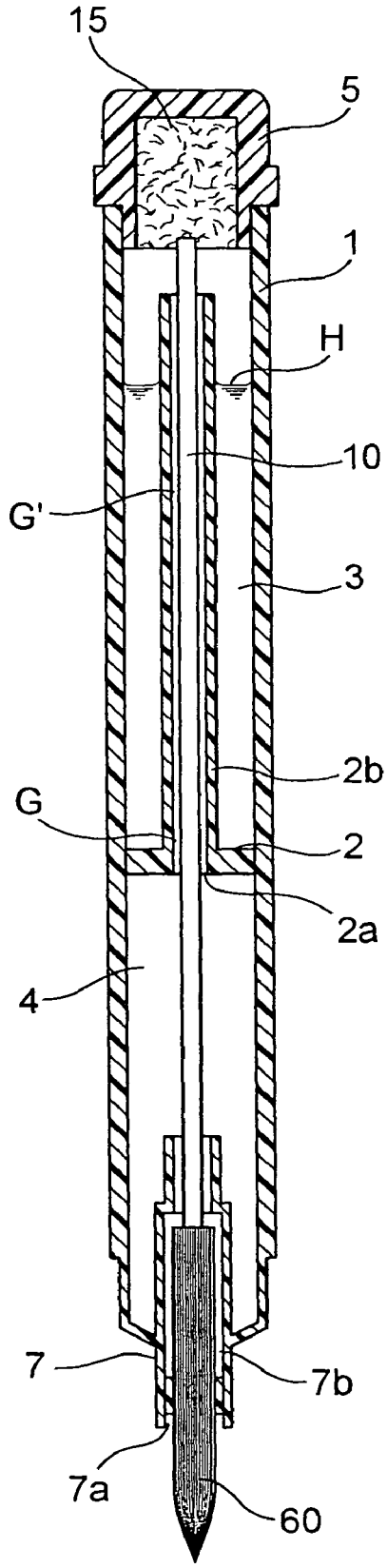
FIG. 17 is a view showing Modification 2 of the above-mentioned Embodiment.
Figure 18:
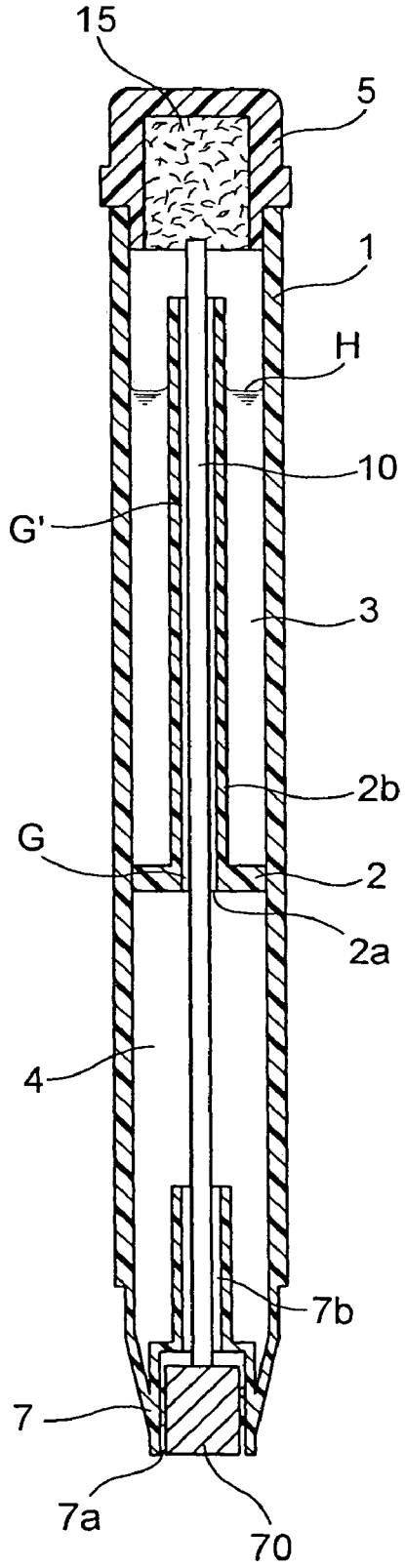
FIG. 18 is a view showing Modification 3 of the above-mentioned Embodiment.
Figure 19:
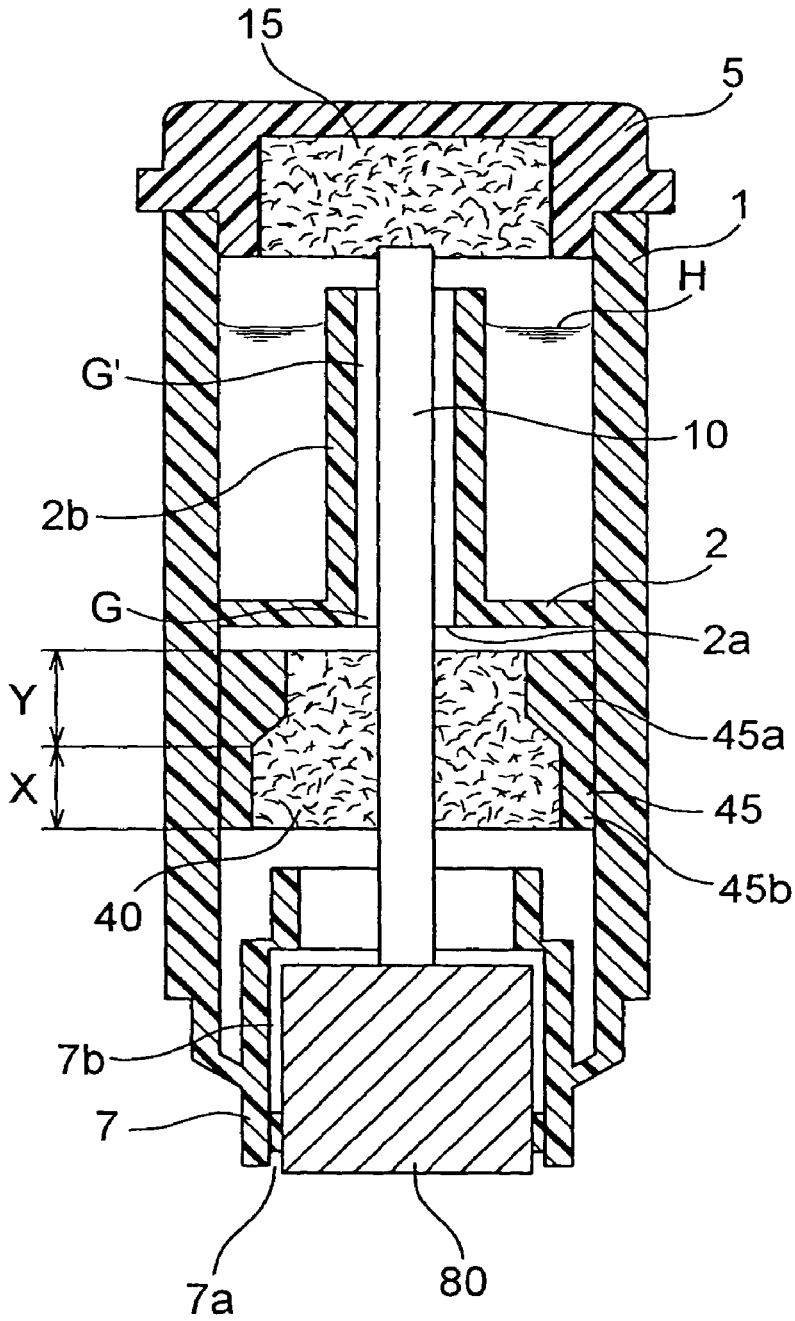
FIG. 19 is a view showing Modification 4 of the above-mentioned Embodiment.

Further, each of the above-mentioned Embodiments describes about the writing instrument as an example of the liquid supply device, but as shown in FIG. 17, a cosmetic device may be configured by holding a brush (application material) 60 coupled to the relay core 10 in the tip portion of the main body 1 to apply a cosmetic liquid (perfume, lotion and the like). Alternately, as shown in FIG. 18, a pen-type stamp device may be configured that a rubber member 70 (application material) for stamp coupled to the relay core 10 is provided in the tip portion of the main body 1. Further, as shown in FIG. 19, a stamp device may be configured that the main body 1 is made wide in diameter and short in length, and that a rubber member 80 (application material) for stamp coupled to the relay core 10 is provided in the tip portion of the main body 1.

In the foregoing, the Embodiments of the invention are described, but the invention is not limited to the above-mentioned Embodiments, and is capable of being carried into practice with various modifications thereof.

The above-mentioned Embodiments describe about the writing instrument beforehand storing the ink (liquid) as an example of the liquid supply device, but the liquid supply device may be configured as a simple container that does not store a liquid. In other words, the device may be configured as a container that a user who purchases the container stores any one of various kinds of liquids in the liquid storage chamber 3 corresponding to each of various usage modes, and applies the liquid using the application material 8. In such a structure, as well as obtaining the action and effects obtained in each of the above-mentioned Embodiments, it is possible to fill the liquid storage chamber 3 with the liquid with ease simply by removing the tail plug 5. Naturally, when the device is used as the writing instrument as described above, a cap may be mounted on the application material 8 side or the tail plug 5 may be configured not to be removed.

Further, structural members in each of the above-mentioned Embodiments are capable of being applied to another Embodiment as appropriate corresponding to the usage mode, type of liquid to store and the like. Furthermore, corresponding to the liquid to use, for example, a structural member may be added optionally, such that a spindle for mixing is sealed in the liquid storage chamber 3, and the like.

Moreover, the relay core 10 may be configured so that the rear end portion thereof is terminated in the middle portion of the partition extending portion 2*b*.

INDUSTRIAL APPLICABILITY

The present invention is applicable to each of various devices that supplies a liquid to an application material from a liquid storage chamber storing the liquid via a relay core coupled to the application material that applies the liquid.

The invention claimed is:

1. A liquid supply device comprising:

a main body having a hollow portion;

a partition that divides the hollow portion into a liquid storage chamber which stores a liquid and a reservoir chamber communicated with the atmosphere and that is provided with a through hole formed in a center portion of the partition;

an application material that is provided in the main body and that applies the liquid in the liquid storage chamber;

a porous relay core that supplies the liquid in the liquid storage chamber to the application material and that is inserted in the through hole to form a gap with an inner wall of the through hole, the gap holding the liquid by capillary force; and a partition extending portion which extends from the partition, and protrudes to a liquid storage chamber side along the relay core, and in which the relay core is inserted to form the gap holding the liquid by capillary force, wherein the partition extending portion is provided in the partition to be higher than a surface of the liquid stored in the liquid storage chamber when the application material is pointed downward, and a second partition provided with a through hole in which the relay core is inserted, is disposed in the reservoir chamber.

2. The liquid supply device according to claim 1, wherein a porous holding material that holds the liquid in the liquid storage chamber is provided on a rear end side of the relay core.

3. The liquid supply device according to claim 2, wherein the rear end portion of the relay core is blocked.

4. The liquid supply device according to claim 1, wherein a liquid absorbing material brought into contact with the relay core to be impregnated with the liquid to hold the ink is provided in the reservoir chamber.

5. The liquid supply device according to claim 4, wherein the liquid absorbing material is formed of a porous material.

6. The liquid supply device according to claim 5, wherein in the liquid absorbing material formed of the porous material, a pore rate on a liquid storage chamber side of the porous material is set to be low, while the pore rate on an application material side of the porous material is set to be high.

7. The liquid supply device according to claim 6, wherein the liquid absorbing material is fitted with a cylindrical holder to be held, and the holder is formed so that an inner diameter on the liquid storage chamber side is smaller than the inner diameter on the application material side.

8. The liquid supply device according to claim 5, wherein in the liquid absorbing material formed of the porous material, a pore rate on the liquid storage chamber side is set to be high, while the pore rate on the application material side is set to be low.

9. The liquid supply device according to claim 5, wherein the liquid absorbing material formed of the porous material has a region where a pore rate is high along a diameter direction, and another region where the pore rate is low along the diameter direction, and the another region where the pore rate is low is provided in at least two or more portions along the axis direction.

10. The liquid supply device according to claim 1, wherein two or more contact portions to come into contact with an outer periphery of the relay core inserted are formed inside the partition extending portion.

11. A liquid supply device comprising:

a main body having a hollow portion;

a partition that divides the hollow portion into a liquid storage chamber which stores a liquid and a reservoir chamber communicated with the atmosphere and that is provided with a through hole formed in a center portion of the partition;

an application material that is provided in the main body and that applies the liquid in the liquid storage chamber;

a porous relay core that supplies the liquid in the liquid storage chamber to the application material and that is inserted in the through hole to form a gap with an inner wall of the through hole, the gap holding the liquid by capillary force;

a partition extending portion which extends from the partition, and protrudes to a liquid storage chamber side along the relay core, and in which the relay core is inserted to form a gap holding the liquid by capillary force; and a tail plug detachable to the main body to open the liquid storage chamber.

12. The liquid supply device according to claim 11, wherein a liquid absorbing material brought into contact with the relay core to be impregnated with the liquid to hold the ink is provided in the reservoir chamber.

13. The liquid supply device according to claim 12, wherein in the liquid absorbing material formed of the porous material, a pore rate on a liquid storage chamber side of the porous material is set to be low, while the pore rate on an application material side of the porous material is set to be high.

14. The liquid supply device according to claim 11, wherein the tail plug is provided with a porous holding material in which an end portion of the relay core is engaged.

15. The liquid supply device according to claim 14, wherein a rear end portion of the relay core is blocked.

16. The liquid supply device according to claim 11, wherein a second partition provided with a through hole in which the relay core is inserted is disposed in the reservoir chamber.

17. A liquid supply device comprising:

a main body having a hollow portion;

a partition that divides the hollow portion into a liquid storage chamber that stores a liquid and a reservoir chamber communicated with the atmosphere and that is provided in a center portion thereof with a tube-shaped partition extending portion which protrudes toward the liquid storage chamber side and which has a through hole;

an application material that is provided in the main body and that applies the liquid in the liquid storage chamber;

a porous relay core that is inserted in the through hole of the partition extending portion and that supplies the liquid in the liquid storage chamber to the application material; and a liquid absorbing material that is provided in the reservoir chamber and that is brought into contact with the relay core to be impregnated with the liquid to hold the link, wherein the partition extending portion has a liquid holding portion in at least part thereof to hold the liquid stored in the liquid storage chamber with the relay core by capillary force, and is higher than a surface of the liquid stored in the liquid storage chamber when the application material is pointed downward, the liquid absorbing material formed of the porous material has a region where a pore rate is high along a diameter direction, and another region where the pore rate is low along the diameter direction, and the another region where the pore rate is low, is provided on an application material side.

18. The liquid supply device according to claim 17, wherein two or more contact portions formed on an inner periphery of the tube-shaped partition extending portion to come into contact with an outer periphery of the relay core are formed in the liquid holding portion.

19. A liquid supply device comprising:

a main body having a hollow portion;

partitions which form a liquid storage chamber that stores a liquid in a center region of the hollow portion, and which are respectively provided on opposite sides of the hollow portion to form reservoir chambers communicated with the atmosphere on opposite sides of the main body;

tube-shaped partition extending portions each of which is formed to have an insertion hole in a center portion of respective one of the partitions and protrudes to inside the liquid storage chamber;

application materials respectively attached to opposite ends of the main body to apply the liquid stored in the liquid storage chamber; and porous relay cores inserted in the partition extending portions to supply the liquid in the liquid storage chamber to the application materials, respectively, wherein each of the partition extending portions has a liquid holding portion in at least part thereof to hold the liquid stored in the liquid storage chamber by capillary force with respective one of the relay cores, and is provided in respective one of the partitions to be higher than a surface of the liquid stored in the liquid storage chamber when respective one of the application materials is pointed downward.

20. The liquid supply device according to claim 19, wherein a liquid absorbing material is provided in each of the reservoir chambers, the liquid absorbing material brought into contact with the relay core and formed of a porous material to be impregnated with the liquid to hold the liquid.

21. The liquid supply device according to claim 19, wherein one of the partition extending portions of the partitions is formed to be longer than the other one of the partition extending portions of the partitions.

* * * * *